US010973388B1

(12) United States Patent
Feeny

(10) Patent No.: US 10,973,388 B1
(45) Date of Patent: Apr. 13, 2021

(54) BEVELED DUST MOP FRAME

(71) Applicant: The Tuway American Group, Inc., Troy, MI (US)

(72) Inventor: John Feeny, Troy, MI (US)

(73) Assignee: The Tuway American Group, Inc., Troy, MI (US)

( * ) Notice: Subject to any disclaimer, the term of this patent is extended or adjusted under 35 U.S.C. 154(b) by 0 days.

(21) Appl. No.: 16/208,736

(22) Filed: Dec. 4, 2018

Related U.S. Application Data

(60) Provisional application No. 62/594,289, filed on Dec. 4, 2017.

(51) Int. Cl.

| | |
|---|---|
| ***A47L 13/10*** | (2006.01) |
| ***A47L 13/24*** | (2006.01) |
| ***A47L 13/42*** | (2006.01) |
| ***A47L 13/253*** | (2006.01) |

(52) U.S. Cl.
CPC ..... *A47L 13/24* (2013.01); *A47L 13/253* (2013.01); *A47L 13/42* (2013.01)

(58) Field of Classification Search
CPC ..... A47L 13/24; A47L 13/42; A47L 13/253; A47L 13/258; A47L 13/254
See application file for complete search history.

(56) References Cited

U.S. PATENT DOCUMENTS

| | | | | |
|---|---|---|---|---|
| 4,225,998 | A | 10/1980 | Theilen | |
| 5,105,136 | A | 11/1992 | Moore | |
| 5,398,492 | A | 3/1995 | Thomas | |
| 5,740,578 | A | 4/1998 | Moore | |
| D553,318 | S | 10/2007 | Fuller et al. | |
| 8,640,296 | B2 * | 2/2014 | Weaver | A47L 13/256 15/208 |
| 9,918,607 | B1 | 3/2018 | Lewis | |
| 2001/0029640 | A1 | 10/2001 | Cassar | |
| 2004/0055102 | A1 | 3/2004 | Treacy | |
| 2006/0085935 | A1 * | 4/2006 | White, II | A47L 13/258 15/228 |
| 2007/0107151 | A1 * | 5/2007 | Pung | B32B 3/30 15/104.94 |

* cited by examiner

*Primary Examiner* — Shay Karls
(74) *Attorney, Agent, or Firm* — Young Basile Hanlon & MacFarlane, P.C.

(57) ABSTRACT

A dust mop frame that includes an elongate body member having a first elongate face and an opposed second elongate face. The elongate body member includes a central body region and at least one projection. The at least one projection has a first region that is connected to the planar central body region, a central region extending angularly outward from the first region at an orientation parallel to the longitudinal axis and an outer terminal edge. The outer terminal edge of the projection is oriented upward relative to the second elongate face of the central body region when the dust mop frame is in the use position. The dust mop also includes at least one handle attachment member connected to the first elongate face; and at least one mop head bundle attachment mechanism connected to the second elongate face.

19 Claims, 3 Drawing Sheets

BEVELED DUST MOP FRAME

The present disclosure claims priority to U.S. Provisional Application Ser. No. 62/594,289 filed Dec. 4, 2017. The specification of which is incorporated by reference herein in its entirety.

TECHNICAL FIELD

This disclosure relates to dust mop frames. More particularly, the present invention pertains to dust mop frames used as a mechanism for attaching a dustmop made of fiberous and/or yarn material to a handle which is used to manuever and direct the appartus to an area to be cleaned.

BACKGROUND

Dust mop frames have been employed to provide a mounting structure on which various dusting media can be attached. Dust mop frames provide various advantages, including but not limited to, increasing the width and breadth of a surface that can be cleaned on a given pass over dust mop head bundles having with less structural stiffness and providing a robust and effective connection between the mop head and the associated handle.

The need for dust mop frames has long been recognized and has resulted in many styles of dust mop frames and accessories. While such devices have been desirable, their ability to pick up dirt and dust have been limited. While rigid frame dust mop assemblies provide enhanced cleaning in certain situations, it has been found that dust mop frames and associated assemblies do not provide a configuration that maximizes cleaning action while stably maintaining the mop head in contact with the dust mop frame.

Thus, it would be desirable to provide a dust mop frame and/or a dust mop assembly including such a dust mop frame, that improves the cleaning ability of the associated mop head, while maintaining it in stable relationship with the dust mop frame. It would also be desirable to provide a dustmop frame which would allow for additional degrees of angles to redirect the position of the mop head when in use to further enhance the effectiveness of the cleaning appartus

SUMMARY

Disclosed herein is a dust mop frame that includes an elongate body member. The elongate body member has a first elongate face and an opposed second elongate face. The elongate body member includes a solid central body region and at least one projection extending therefrom along at least a portion of the elongate length. The at least one projection has a first region that is connected to the planar central body region, a central region extending angularly outward from the first region at an orientation parallel to the longitudinal axis and an outer terminal edge. The outer terminal edge of the projection is oriented upward relative to the second elongate face of the central body region when the dust mop frame is in the use position. The dust mop also includes at least one handle attachment member connected to the first elongate face; and at least one mop head bundle attachment mechanism connected to the second elongate face.

Also disclosed is a mop head that includes the dust mop frame and at least one mop head bundle. The dust mop head bundle includes a body having a floor contacting region and at least one attachment mechanism, the attachment mechanism configured to engage the at least one mop head attachment mechanism on the dust mop frame.

These and other aspects of the present disclosure are disclosed in the following detailed description of the embodiments, the appended claims and the accompanying figures.

BRIEF DESCRIPTION OF THE DRAWINGS

The invention is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity.

DETAILED DESCRIPTION

Figure 1:
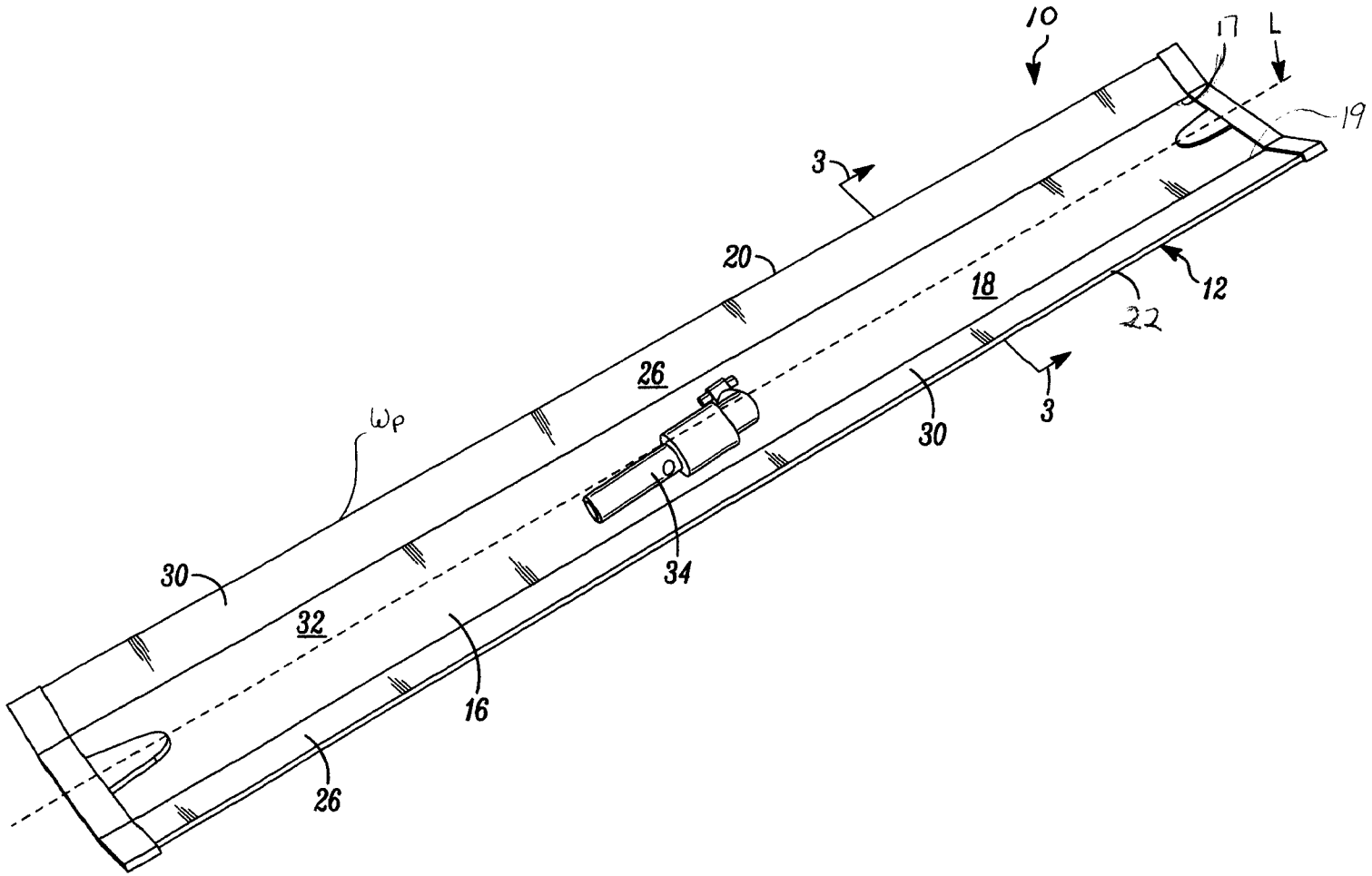
FIG. 1 is an upper perspective view of an embodiment of a dust mop frame as disclosed herein.

The present disclosure is directed to dust mop frames that can be mounted to a handle member either temporarily or permanently. The connection between the dust mop frame can be either fixed or one that accommodates the dust mop frame to pivot or swivel relative to the mop handle. The dust mop frame as disclosed herein can accommodate one or more dust mop head bundles in attachment thereon such that the dust mop frame is interposed between at least a portion of the dust mop head bundle and the handle member. The dust mop head bundle can be either permanently attached to the dust mop frame or can be detachably mounted thereto.

As disclosed, the dust mop frame includes an elongate body member which, in the use position, has a floor contacting face and a handle mounting device that is configured on the elongate body member at a location opposed to the floor contacting face. An embodiment of the dust mop frame as disclosed is depicted in FIG. 1.

Dust mop frame 10 includes an elongate body member 12 that has a first elongate face 14 and an opposed second elongate face 16. In FIG. 1, the first elongate face 14 is oriented toward a floor surface when the dust mop frame 10 is in the use position. The elongate body member 12 is composed of a central body region 18 and at least one projection 20 that extends outward from the central body region 18.

The elongate body member 12 can be constructed from a variety of materials including, but not limited to, various polymeric resins, metals, metal alloys and the like. It is contemplated that the material of choice will be one that will provide suitable rigidity for an associated mop head bundle (not shown). In the embodiment depicted, the elongate body member 12 is a solid body however various other configurations are considered to be within the purview of this disclosure. In certain embodiments, the solid body can be composed of suitable autoclavable material such as stainless steel and the like.

Figure 2:
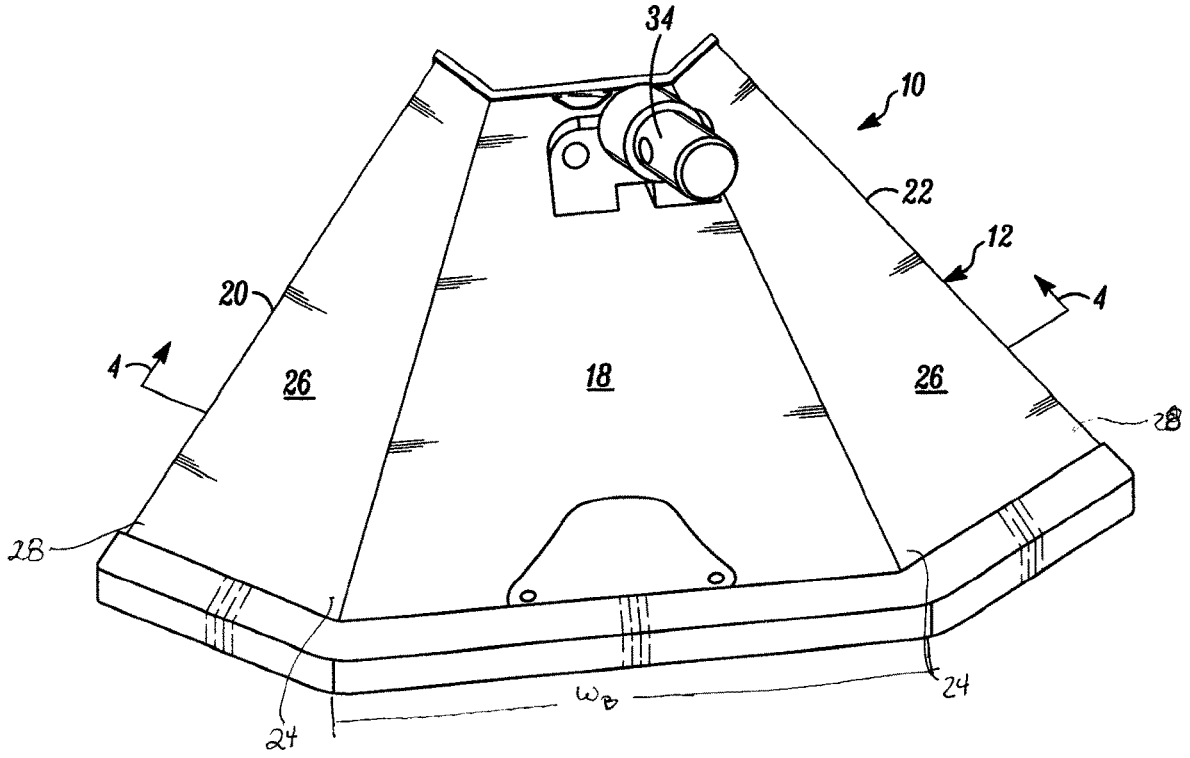
FIG. 2 is a side view of the dust mop frame of FIG. 1.

In the embodiment depicted in FIGS. 1 and 2, two opposed projections 20 and 22 are contiguously connected to the central body region 18 and therefrom such that the central body region 18 is interposed between the opposed projections 20 and 22. The central body region 18 can be an elongate member. In certain embodiments, the central body region 18 will be configured as a rectangle such as the rectangular body depicted in the various drawing figures. The central body region 18 can have a longitudinal axis L extending therethrough. In the embodiment illustrated the central body region 18 includes two opposed side regions 17, 19 to which the two opposed projections 20 and 22 are each contiguously connected.

The at least one projection 20, 22 is oriented such that it is angled relative to the central body region 18. In various embodiments, the dust mop frame 10 can include two opposed projections 20, 22 that are symmetrically disposed relative to a central or longitudinal axis L that extends through the central body region 18. In the embodiment depicted in FIGS. 1A and 1B and FIG. 2, the projections 20 and 22 are each configured as rectilinear members that have a consistent dimension throughout their respective lengths. Other configurations are contemplated. In certain embodiments, the two opposed projections 20 and 22 can be asymmetrical relative to one another. In certain embodiments, the dust mop frame 10 may have only one projection 20, if desired or required.

In the embodiment depicted in FIG. 1, the at least one projection 20, 22 has a first region 24, 24 that is contiguously connected to the central body region 18. The at least one projection 20, 22 also has a central region 26, 26 that is oriented parallel to the longitudinal axis L of the central body region 13 of the elongate body member 12. A terminal edge 28, 28 is located opposite the respective first region 24, 24. The terminal edge 28, 28 can be configured as a generally straight edge region that is parallel to the longitudinal axis L in the longitudinal orientation as illustrated in FIG. 1. Alternately, one or both terminal edges 28, 28 can be angled relative to the longitudinal axis L. It is also contemplated that one or more of the terminal edges 28, 28 can be have any suitable shape. Non-limiting examples of such shapes include edges that the curved, scalloped or have other configurations as desired or required.

Figure 3:
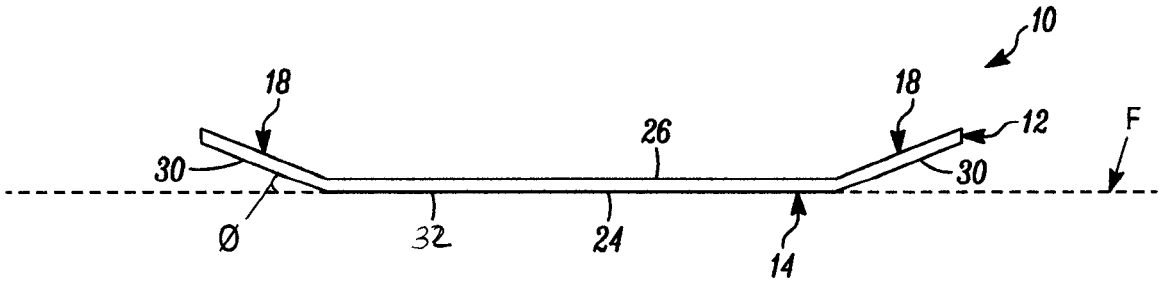
FIG. 3 is a cross-sectional view taken along the 3-3 line of FIG. 1.
Figure 4:
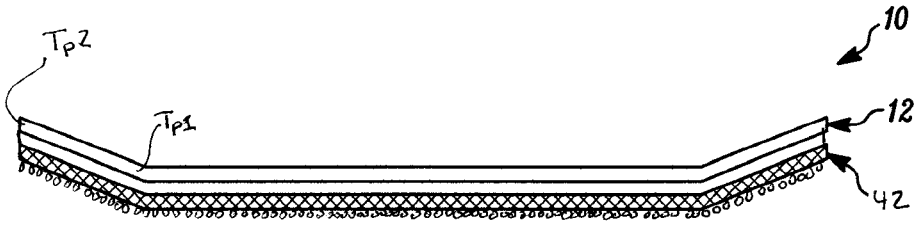
FIG. 4 is a cross sectional view of an embodiment of a dust mop frame as disclosed herein with a configuration of a dust mop head attached.

As illustrated in FIG. 3, at least one projection 20, 22 has a face region 30, 30 that is contiguous to the respective localized face region 32 of the central body region 18. Together, these localized face regions 30, 30, 32 collectively from first elongate face 14 of dust mop frame 10. The respective face regions 30, 30 of projections 20, 22 are angled relative to the face region 32 of the central body region 18 such that the respective terminal edge 28, 28 of the respective projections 20, 22 is located at a position that is above the localized face region 32 of central body region 18 when the dust mop frame 10 is in the use position such as would occur when dust mop frame 10 is positioned on a floor surface F. The angle θ formed between face region 32 of central body region 18 and face region 30, 30' of the respective projection 20,20 can be an acute angle; with an angle θ between 10° and 75° being employed in certain embodiments. In certain embodiments, it is contemplated that the angle θ will be between 20° and 45°.

The central body region 18 can have any suitable thickness. In the embodiment depicted in FIG. 1, the central body region 18 is a generally planar member having a thickness $T_B$. The at least one projection 20, 22 can also have a generally planar configuration. In certain embodiments, the at least one projection 20, 22 can have a thickness $T_P$ that is generally equal to the thickness $T_B$ of the central body region 18 at the respective first region(s) 24, 24. The thickness of the at least one projection 20, 22 can be consistent through the width $W_P$ of the associated projection 20, 22 or can taper from a thickness maximum $T_P$1 located proximate to the first region(s) 24, 24 to a lesser thickness $T_P$2 located proximate to terminal edge 28, 28.

The dust mop frame 10 can also include at least one mop handle attachment member 34 that is connected to the elongate body member 12 of the dust mop frame 10. In the embodiment depicted in FIG. 1, the at least one mop handle attachment member 34 is connected to the second elongate face 16 of the elongate body member 12 of the dust mop frame 10. In certain embodiments, the mop handle attachment member 34 can be located on the elongate body member in a manner that facilitates movement of the dust mop frame 10 over the surface to be cleaned. In the embodiment illustrated in various drawing figures, the mop handle attachment member 34 can be connected to elongate body member 12 in the central body region 18 of the dust mop frame 10. As broadly construed, the mop handle attachment member 34 can include least one device that is adapted to removably or permanently connect with a terminal end of mop handle (not shown) to operatively connect the mop handle to the dust mop frame 10. The mop handle can have a variety of configurations. In certain embodiments, the mop handle will be configured as an elongated dowel. Various embodiments of mop handle attachment member 34 will be presented subsequently.

The dust mop frame 10 is configured to support a suitable surface cleaning member. The surface cleaning member can be configured as a mop head bundle such as dust mop head 42. The mop head bundle 42 can be connected to the dust mop frame 10 by a suitable mop head bundle attachment mechanism 44. The one mop head bundle attachment mechanism 44 can be located at a position on elongated body member of the dust mop frame 10 suitable for the maintaining the mop head bundle connected to the dust mop frame 10 in a suitable use position.

The mop head bundle 42 can be made of one or more materials including but not limited to woven and non-woven fabric sheet stock, yarn or tufted materials, etc. The mop head material can be composed of one or more of a variety of synthetic or natural materials as well as combinations of the two. Where desired or required, the material of the mop head bundle 42 can be composed washable reusable material. It is also contemplated that mop head bundle can be composed of disposable material, where desired or required.

In certain embodiments, the mop head bundle 42 can be configured with pile or tuft regions of varying height on different regions of the mop head. In certain embodiments, the pile can be deeper in regions associated with the respective projections 20, 20' with a lower pile region at the portion of the mop head bundle 42 that is associated with the central body region 18. Where desired or required, the pile can be cut pile or loop pile. It is also contemplated that the material can be a woven or felted material having a weave suitable to retain dust dirt or the like. It is also contemplated that one or more regions located on mop bundle 42 associated with the central body region 18 of the dust mop frame 10 can be configured with material that can aid in agitation of dirt material present on the floor surface to be cleaned. In certain embodiments, the agitation regions can be configured with material of greater stiffness than the surrounding regions. The material in the one or more agitation regions can be composed of bristle like material where desired or required.

In certain embodiments, the region of the mop head bundle 42 associated with the central body region 18 can be a woven material, a pile or tufted material or a combination of the two. Where pile is employed in the region of the mop head bundle 42 associated with the central body region 18 of the dust mop frame 10, it is contemplated that the pile will have an average height between 0.2 inches and 2 inches.

In certain embodiments, it is contemplated that the region (s) of the mop head bundle 42 that is associated with the respective projections 20, 20' of the dust mop frame can have length and/or density value(s) to effectively collect and maintain dust and dirt that initially comes in contact with the dust mop frame 10 in regions associated with the leading edge(s) 28, 28'. In certain embodiments, it is contemplated that the pile employed in the region(s) of the mop head bundle 42 associated with the respective projections 20, 20' of the dust mop frame 10 can be equipped with a pile region having a thickness and/or density that differs from that of the pile present in the region of the mop head bundle 42 associated with the central region 18 of the dust mop frame 10. In certain embodiments, the pile located in regions of the mop head bundle 42 that is associated with the respective projections 20, 20' can have a thickness and/or density and or length that is greater than pile located in other regions of the mop head bundle 42.

Dust mop frames can also include means for connecting the respective dust mop frame to the handle member as well as means or devices to connect the mop head member to the frame. The dust mop frames that have been proposed have a generally elongated body that provides a flat planar lower surface configured to maximize the contact area between the associated mop head with the floor to be mopped.

While the invention has been described in connection with certain embodiments, it is to be understood that the invention is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A dust mop frame, the dust mop frame comprising:

an elongate body member, the elongate body member having a first elongate face and a second elongate face opposed to the first elongate face, the elongate body member including:

a central body region having a length and defining a longitudinal axis and a width transverse to the longitudinal axis, the central body region having a first central body face and an opposed second central body face, and at least one projection having a first region contiguously connected to the central body region in fixed relation thereto, the at least one projection having a central region extending angularly outward from the first region and connected to the first region at an orientation parallel to the longitudinal axis of the central body region and an outer terminal edge, wherein the outer terminal edge is oriented upward relative to the first central body face when the dust mop frame is in a use position, wherein the at least one projection is immovable relative to the central body region and forms an angle with the central body, the angle having a value between 100° and 175° as measured from the second central body face and the central region of the at least one projection, wherein the at least one projection and the central body region form a solid junction region;

at least one handle attachment member connected to the second elongate face of the elongate body; and at least one mop head bundle attachment mechanism connected to first elongate face of the elongate body.

2. The dust mop of claim 1 wherein the central body region is planar.

3. The dust mop frame of claim 1 wherein the at least one projection has a projection length, wherein the projection length is equal to the length of the central body region.

4. The dust mop frame of claim 1 wherein the angle has a value between 145° and 170°.

5. The dust mop frame of claim 1 wherein the central body has a width $W_B$ and the at least one projection has a width $W_P$ wherein $W_P$ is less than $W_B$.

6. The dust mop of claim 5 wherein $W_P$ has a value that is between 10% and 70% of $W_B$.

7. The dust mop frame of claim 1 wherein the elongate body member is a solid body.

8. The dust mop frame of claim 7 wherein the elongate body is composed of an autoclavable material.

9. The dust mop frame of claim 7 wherein the elongate body is composed of stainless steel.

10. The dust mop frame of claim 1 further comprising at least one mop head bundle, the mop head bundle comprising a substrate having a first face and an opposed second face, the substrate having dimensions sufficient to overlay at least a portion of the first elongate face of the elongate body member, wherein the first face of the substrate is proximate to the first elongate face of the elongate body member and the second face of the substrate member has a debris collecting surface, the debris collecting surface composed of a pile region, the pile region including tufts of at least one of cut loop pile or loop pile.

11. The dust mop frame of claim 10 wherein at least a portion of the dust collecting surface of the second face of the substrate member is composed of a pile region, the pile region including a plurality of tufts projecting outward from the second face of the substrate member to at least one length, wherein the tufts are at least one of cut pile or loop pile, wherein the tufts located proximate to the at least one projection are longer than tufts located proximate to the central body region.

12. The dust mop frame of claim 11 wherein the mop head bundle further comprises at least one agitation region, wherein the agitation region is located in the mop head bundle at a location associated with the central body region.

13. A dust mop frame, the dust mop frame comprising:

an elongate body member, the elongate body member having a first elongate face and a second elongate face opposed to the first elongate face, the elongate body member including:

a planar central body region having a length and a width $W_B$ transverse to the longitudinal axis, the central body region having a first central body face and an opposed second central body face, and at least two projections, each projection having a first region contiguously and fixedly connected to the central body region in a fixed relationship thereto, a central region extending angularly outward from the first region connected to the first region at an orientation parallel to the longitudinal axis of the central body region and an outer terminal edge, wherein the outer terminal edge is oriented upward relative to the first central body face when the dust mop frame is in a use position, each projection having a width $W_P$ that is less than $W_B$ wherein the central body region is positioned between the at least two projections;

at least one handle attachment member connected to the second elongate face of the elongate body;

at least one mop head bundle attachment mechanism connected to first elongate face of the elongate body; and at least one mop head bundle, the mop head bundle comprising a substrate having a first face and an opposed second face, the substrate having dimensions sufficient to overlay at least a portion of the first elongate face of the elongate body member, wherein the first face of the substrate is proximate to the first elongate face of the elongate body member and the second face of the substrate member has a debris collecting surface, wherein the debris collecting surface is composed of a pile region, the pile region including tufts of at least one of cut loop pile or loop pile, the mop head bundle further comprising additional regions, the addition regions each configured to overlie an associated projection, the additional regions each being composed of cut loop pile or loop pile.

14. The dust mop frame of claim 13 wherein the width $W_P$ of at least one of the two projections has a value between 10% and 70% of $W_B$.

15. The dust mop frame of claim 13 wherein the at least one of the projection forms an angle with the central body region and wherein the angle that has a value between 100° and 175° as measured from the second central body face and the central region of the at least one of the projection.

16. The dust mop frame of claim 13 further comprising at least one mop head bundle, the mop head bundle comprising a substrate having a first face and an opposed second face, the substrate having dimensions sufficient to overlay at least a portion of the first elongate face of the elongate body member, wherein the first face of the substrate is proximate to the first elongate face of the elongate body member and the second face of the substrate member has a debris collecting surface.

17. The dust mop frame of claim 16 wherein at least a portion of the dust collecting surface of the second face of the substrate member is composed of a plurality of tufts projecting outward from the second face of the substrate member to at least one length.

18. The dust mop frame of claim 17 wherein the tufts located proximate to the at least one projection is longer than tufts located proximate to the central body region.

19. The dust mop frame of claim 18 wherein the wherein the mop head bundle further comprises at least one agitation region, wherein the agitation region is located in the mop head bundle at a location associated with the central body region.

* * * * *